United States Patent [19]

Amati et al.

[11] Patent Number: 4,740,210

[45] Date of Patent: Apr. 26, 1988

[54] FATTING COMPOSITIONS CONTAINING SURFACE-ACTIVE PHOSPHORIC ACID PARTIAL ESTERS

[75] Inventors: Werner Amati, Hersberg; Markus Badertscher, Birsfelden, both of Switzerland

[73] Assignee: Sandoz Ltd., Basel, Switzerland

[21] Appl. No.: 703,698

[22] Filed: Feb. 21, 1985

[30] Foreign Application Priority Data

Feb. 22, 1984 [DE] Fed. Rep. of Germany ..... 3406277

[51] Int. Cl.[4] ..... C14C 5/00; C14C 11/00; C14C 9/00

[52] U.S. Cl. ..... 8/94.23; 8/94.1 P; 252/8.57

[58] Field of Search ..... 8/94.1 P, 94.22, 94.23; 252/8.57

[56] References Cited

U.S. PATENT DOCUMENTS

| | | | |
|---|---|---|---|
| 2,086,792 | 7/1937 | Fabian et al. | 8/94.23 |
| 2,280,310 | 4/1942 | Koppenhoefer | 8/94.23 |
| 3,010,780 | 11/1961 | Plapper et al. | 8/94.26 |
| 3,770,372 | 11/1973 | Luvisi | 8/94.23 |
| 4,309,176 | 1/1982 | Friese et al. | 8/94.23 |

FOREIGN PATENT DOCUMENTS

| | | | |
|---|---|---|---|
| 0087799 | 9/1983 | European Pat. Off. | 8/94.1 P |
| 2517057 | 10/1976 | Fed. Rep. of Germany | 8/94.1 R |
| 2105745 | 3/1983 | United Kingdom . | |

*Primary Examiner*—Paul Lieberman
*Assistant Examiner*—John F. McNally
*Attorney, Agent, or Firm*—Gerald D. Sharkin; Richard E. Vila; Thomas C. Doyle

[57] ABSTRACT

Process for the fatting and hydrophobizing of tanned leather and pelts, wherein the tanned leather or pelt is fatted with an aqueous dispersion containing a natural optionally chemically modified leather fatting agent and a surface-active phosphoric acid partial ester and optionally a non-ionic and/or an anionic carboxy group and/or sulfo group containing surfactant and subsequently treating the fatted leather or pelt in aqueous medium with a polyvalent metal cation; the treated substrates and the dispersions suitable for carrying out the process.

43 Claims, No Drawings

FATTING COMPOSITIONS CONTAINING SURFACE-ACTIVE PHOSPHORIC ACID PARTIAL ESTERS

The invention relates to a process for fatting tanned leather or pelts by means of particular dispersions of fatting agents, to the dispersions of the fatting agents and their production and to the fatted substrates.

Thus, the invention provides a process for fatting tanned leather and pelt substrates, comprising the steps of fatting the substrate with an aqueous dispersion containing (a) a natural leather-fatting agent or a chemically modified natural leather-fatting agent and (b) a surface-active phosphoric acid partial ester and after-treating the substrate in an aqueous medium with a polyvalent metal cation.

The fatting agent (a) may be any usual natural animal, vegetable or mineral fat, fat oil, wax, resin or resin oil or chemically modified animal or vegetable fat or oil and include: tallow, fish oils, neats foot oil, olive oil, caster oil, rapeseed oil, linseed oil, wood oil, cottonseed oil, sesame oil, corn oil and Japanese tallow and chemically modified products thereof (e.g. hydrolysis, transesterification, oxidation, hydrogenation and sulphation products), bees wax, Chinese wax, carnauba wax, montan wax, wool fat, colophony, birch oil, shellack, mineral oils with boiling range within 300° and 370° C. (particularly the so-called "heavy alkylates"), soft paraffin, medium paraffin, hard paraffin, Vaseline® petroleum jelly ceresine and methyl esters of $C_{14-22}$ fatty acids. Preferred fatting agents (a) chemically non-modified natural fatting agents and methyl esters of $C_{14-22}$-fatty acid, particularly tallow, fish oils, neats foot oil, olive oil, castor oil, paraffins, Vaseline® petroleum Jelly mineral oil, heavy alkylates, ceresin, wool fat, methyl esters of $C_{14-22}$-fatty acids and "heavy alkylates"; particularly preferred is wool fat, alone or together with "heavy alkylates". Chemically modified anionic products, especially hydrolysis and sulphation products come preferably into consideration as additional anionic surfactants that may be present, together with the fatting agent as described below.

The surface-active phosphoric acid partial esters are preferably hydrosoluble and/or hydrodispersible and are preferably orthophosphoric acid or pyrophosphoric acid esters of higher aliphatic fatty alcohols or of mono- and/or polyalkylene glycol monoethers of higher fatty alcohols, in the form of the free acids and/or of the alkali metal or ammonium salts thereof. The higher alcohols are preferably alkanols or alkenols with 14–20 carbon atoms, which may be oxalkylated and contain on the average 0–10, preferably 2–10, more preferably 2–6 alkylene oxide units per fatty alcohol radical, alkylene signifying ethylene-1,2 or propylene-1,2; where the molecule contains alkylene oxide units, advantageously at least a part of them is ethyleneoxy; preferably all of the alkyleneoxy units are ethyleneoxy. Preferably 2–6, more preferably 3–5, ethyleneoxide units are present per fatty alcohol radical.

The higher aliphatic alcohols may be unsaturated or preferably saturated and are preferably primary n-alkenols or more preferably n-alkanols with 14–20 carbon atoms; preferred alcohols are selected from the following: tetradecanol, cetyl alcohol, oleyl alcohol and stearyl alcohol, as well as technical mixtures comprising or consisting of such alcohols, particularly tallow alcohol. Most preferred are the alcohols with 16–18 carbon atoms.

Most preferred oxalkylated alcohols are the oxethylation products of cetyl alcohol, stearyl alcohol, oleyl alcohol and tallow alcohol with 3–5 ethylene oxide units per molecule.

The addition of the alkylene oxide to the alcohol may be carried out by known methods, e.g. by reaction of the alcohols with the alkylene oxides in the presence of catalytic quantities of an alkali metal hydroxide at elevated temperature or also according to other known methods.

The phosphoric acid partial esters are preferably at least in part in the form of their salt. They may be produced according to known methods, e.g. by reaction of the higher alcohols or their mono- or polyalkylene glycol monoethers with phosphorus pentoxide, phosphorus oxychloride or polyphosphoric acid. After the reaction the partial esters may, if desired, be reacted with a corresponding base, which may be in the form of an aqueous solution, to give the corresponding optionally acid salts thereof. The cations for the salt formation may be mainly alkali metal cations (particularly lithium, sodium and potassium, preferably sodium and potassium) and ammonium; the ammonium may be substituted or unsubstituted; the substituted ammonium may be substituted by alkyl with 1–2 carbon atoms and/or alkanol with 2–3 carbon atoms and may be e.g. mono-, di- and trialkylammonium, mono-, di- and trialkanolammonium and alkylated mono- or dialkanolammonium, preferably mono-, di- and trimethylammonium, mono-, di- and triethylammonium, mono-, di- and triisopropanolammonium, mono-, di- and triethanolammonium and methylethanolammonium. For salt formation from the partial ester, the mentioned cations may be added as aqueous solutions of the corresponding hydroxides or for alkaline metals, also as the corresponding salts of weak acids (e.g. as alkaline metal carbonates or bicarbonates); for the production of amine salts the corresponding amines may be added as aqueous solutions or preferably in water-free form.

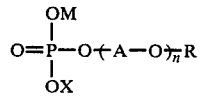

(I)

and

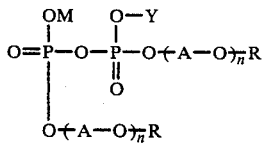

(II)

in which M signifies hydrogen, alkali-metal or ammonium, x and Y signify M or —(A-O)$_n$R, each R independently is $C_{14-20}$-alkyl or $C_{14-20}$-alkenyl, each A independently is ethylene-1,2 or propylene-1,2 and each n independently is 0 or an average number from 1 to 10 and where n>1, the alkylene groups A within the group —(A-O)$_n$ may be the same or different.

A preferred aspect of the invention lies in the combined use of phosphoric acid partial esters of the non-oxalkylated fatty alcohols described above, in particular esters of the above formulae, wherein n is 0 with phosphoric acid partial esters of the oxalkylated fatty alcohols described above, in particular esters of the above formulae, wherein n is other than 0, preferably 2–10 (more preferably 2–6 ethylene oxide units) the compounds of formula (I) being particularly preferred.

The weight ratio of the above described phosphoric acid partial esters of non-oxalkylated fatty alcohols to the above-described partial esters of oxalkylated fatty alcohols is preferably in the range of 1:5 to 1:0.5, more preferably in the range of 1:4 to 1:1.

In the above formula the indices n represent average values of the number of added alkylene oxide units to the respective alcohols; also the radicals R may correspond to average significances if the starting alcohol is not a single component, but e.g. a technical mixture of alcohols. Formula (II) represents compounds that may exist practically only in a water-free or nearly water-free medium, since in the presence of water they are hydrolized to compounds of formula (I). In formula (II) M is preferably hydrogen and, if Y signifies M, this is also preferably hydrogen. If the above partial esters are di-basic monoesters as the compounds of formula (I), in which X is M, then preferably only one of the two hydroxy groups is neutralized so that one of the two symbols M means hydrogen and the other means a cation as indicated above. For the production of the salt form s the phosphoric acid partial esters are preferably reacted with the corresponding base up to a pH of preferably 5–8, more preferably 6–8. Most preferably the reaction with the base resp. the adjustment of the pH is carried out only after admixing with the fatting agent and optionally with further surfactants.

The phosphoric acid partial esters to be used according to the invention are preferably hydrosoluble or hydrodispersible, the hydrosoluble products being defined as being soluble in distilled water at 20° C. at a concentration of at least 3 g/l and the hydrodispersible products being defined as products that give aqueous dispersions in the absence of added surfactant, the size (diameter) of the particles dispersed in water being not greater than 5 μm.

The hydrosolubility of the hydrosoluble products is preferably at least 10 g/l at 20° C. and for the hydrodispersible products the size of all particles in the dispersion is preferably not greater than 5 μm.

The phosphoric acid partial esters are preferably mixed with further anionic carboxy- and/or sulpho group containing surfactants and/or nonionic surfactants (preferably surfactants with emulsifying properties). The further anionic and non-ionic surfactants may be advantageously one or more of the following:

(I) addition products of 1–100 moles ethylene oxide to 1 mole of a $C_{4-24}$-alcohol, phenol or a mono- or di($C_{1-12}$-alkyl)phenol; preferably addition-products of 4–70 moles ethylene oxide to 1 mole of an aliphatic $C_{6-22}$-alcohol, preferably a $C_{12-22}$-alcohol, particularly saturated alcohols which include tetramethylnonyl alcohol, lauryl alcohol, myristyl alcohol, cetyl alcohol, stearyl alcohol, arachidyl alcohol or behenyl alcohol and unsaturated alcohols which include oleyl alcohol; more preferably addition-products of 10–70 ethyleneoxide units to these alcohols; also preferred are phenolalkyleneoxides (1–50) and ($C_{1-12}$-alkyl)$_{1-2}$-phenolalkyleneoxides (1–50);

(II) carboxymethyl derivatives of the compounds mentioned under (I), e.g. their reaction products with chloracetic acid;

(III) $C_{12-22}$-fatty acids or soaps;

(IV) sulphation products of the compounds mentioned under (I) of the formula $R_1—O—(CH_2—CH_2—O)_m—SO_3M$, wherein $R_1$ signifies the hydrocarbon radical of the alcohol or phenol mentioned under (I), m being preferably 1–25 and M hydrogen or a cation as mentioned above;

(V) alkylbenzene sulphonates and paraffin sulphonates.

Preferably at least some of the surfactants have O/W-emulsifier character.

The anionic surfactants may also be employed in the form of the corresponding salts, wherein the cations may be as indicated above for the phosphoric acid partial esters.

The weight ratio of the phosphoric acid partial esters to the further surfactants is advantageously between 1:10 and 60:1, preferably from 1:1 to 50:1, more preferably from 5:1 to 25:1.

The dispersion of the invention may be produced in known manner, suitably by admixing the above defined fatting agent and surfactants, if necessary heating to melt the components and addition water (if necessary with agitation); a compound for the adjustment of the pH-value may be added before and/or after the addition of water. The pH-value of the dispersion is advantageously in the range of from 3.5 to 10, preferably from 5 to 9, more preferably from 6.5 to 8 and may be adjusted by addition of known bases, especially as suitable for the formation of the above-mentioned salts of the phosphoric acid partial esters (e.g. alkali metal hydroxide solution, ammonia or amines).

The weight ratio of the above-defined fatting agent (a) to the total of the surfactants present in the dispersions of the invention is advantageously in the range of from 1:0.5 to 1:3, preferably 1:0.7 to 1:2.5, more preferably 1:0.7 to 1:2. The optimum amount of the surfactant is mainly dictated by its emulsifier ability and the desired stability of the dispersion and may be determined by a few simple trials.

If desired, there may be added to the dispersions liposoluble fungicides.

The dry substance content of the dispersions of the invention is preferably in the range of 10–65%, more preferably 30–60% (with respect to the total weight of the dispersion); if desired or necessary they may be diluted before they are used for the treatment of leather.

Any kind of leather and pelt that has been tanned by any usual tanning method, in particular vegetable, mineral, synthetic or combined tanned (e.g. chrome-tanned, zirconyl zirkonyl-tanned or aluminium-tanned) or also correspondingly re-tanned and as, in general, employed as a substrate for known fatting methods, may be treated with the dispersions of the invention and by the method of the invention. The following preferred kinds of leather may be mentioned: gain leather, e.g. nappa from sheep, goat or cow, box-leather from calf or cow, sueded leather, e.g. velours from sheep, goat or calf and hunting leather, split velours from cow- or calf-skin and nubuk-leather, further also fur-bearing sueded leather and furs for clothing.

Optionally, the substrate may have been dyed in a separate dye bath before the fatting treatment or the fatting treatment may be carried out subsequent to the dyeing step in the same aqueous medium from which the substrate has been dyed.

The fatting of the leather or pelts according to the invention may be carried out according to any manner known per se, suitably by exhaustion. The concentration of the fatting agent (a) is preferably within the range of 0.2–15%, more preferably 2–8% by weight with respect to the wet-weight of the leather; the aqueous treatment liquors are preferably from slightly alkaline to clearly acid (particularly pH 2–9), preferably the liquor is neutral to slightly acid (pH 4–7). The fatting with these aqueous liquors is carried out preferably in the temperature range between 20° and 70° C., more preferably between 40° and 60° C. The pH may be suitably adjusted with known acid, bases and/or buffers, preferably with formic acid, ammonium carbonate or alkali metal carbonate.

Upon treatment with the described fatting agents the substrates are after-treated with polyvalent metal or metal oxy cations. The polyvalent cations for the after-treatment are preferably magnesium, calcium, barium, aluminium, chromium-(III) and zirconyl of which aluminium, chromium-(III) and zirconyl are preferred. The after-treatment is suitable carried out by addition of corresponding compounds of the polyvalent metals, in particular of their oxides, hydroxides and/or salts to the aqueous treatment liquor, the hydrosoluble salts being preferred, in particular aluminum sulfate, potassium alum, chromium-(III)-sulfate, potassium chromium alum, chromium hydroxy sulfate, zirconyl-chloride, zirconyl-sulfate and zirconyl-acetate.

The concentration of the above-mentioned after-treatment compounds, calculated as metal cations, with respect to the dry weight of the phosphoric acid partial ester is preferably in the range of from 1–100%, more preferably 5–20%. The after-treatment is preferably carried out by exhaustion from aqueous medium. A particular aspect of the invention is the after-treatment of the fatted substrate with the polyvalent cations by exhaustion from the same aqueous medium as that in which the fatting step was carried out, just after the fatting procedure (optionally with an intermediate dyeing step also in the same aqueous medium). The polyvalent metal compound for the after-treatment is advantageously added only after the build-up of the fatting agent on the substrate is practically complete. The after-treatment is preferably carried out at temperature between 20° and 70° C., more preferably between 40° and 60° C., preferably under slightly alkaline to clearly acidic conditions (in particular pH 2–9), more preferably under neutral to slightly acidic conditions (in particular pH 4–7). The pH is advantageously adjusted with known acid bases and/or buffers as already indicated for the fatting step. If fatting and after-treatment are carried out in the same aqueous medium, a correction of the pH-value for the after-treatment may be unnecessary. On completion of the after-treatment with the polyvalent cations the leather and pelts may be finished by known methods.

By the fatting and after-treatment process of the invention there are obtained optimally fatted and also highly water-repellant leathers and pelts with notable tear-resistance, suppleness and good handle and which further exhibit the fastnesses as usually required for leather.

The following examples illustrate the invention. Parts and percentages are by weight. The following surfactants are used in the following examples:

| Surfactants of formula (I) | R | n | A | X | M |
|---|---|---|---|---|---|
| surfactant A | tallow alkyl | 3,8 | $-CH_2-CH_2-$ | H | H |

-continued

| Surfactants of formula (I) | R | n | A | X | M |
|---|---|---|---|---|---|
| surfactant B | tallow alkyl | zero | | H | H |

Surfactant C:

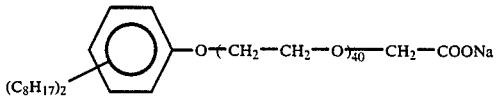

Surfactant D: $C_{18}H_{35}-O-(CH_2-CH_2-O)_{60}-H$ (Oleyl)
Surfactant E: Oleic acid
Surfactant F: Stearic acid.

The percent indications in example 4 refer, if not otherwise indicated, to the wet-weight of the leather.

EXAMPLE 1

10 g of surfactant a, 110 g of surfactant B, 5 g of surfactant C and 180 g of neutral wool-fat are melted together in a glass vessel and homogenously mixed; when the melt appears to be clear and homogenous there are added slowly and with stirring by means of an anchor-stirrer, 467ml of demineralised water, the temperature being maintained at 55°–60° C. At the beginning there is formed a water-in-oil-emulsion, which then inverts to an oil-in-water-emulsion; the phase-inversion beginning when about 30% of the water has been added. When all of the water has been added, the heating is interrupted. Then 95ml of a 30% sodium hydroxide solution are added slowly until the pH is 7.0. The emulsion s then ready for use.

EXAMPLE 2

In a reaction vessel fitted with a stirrer 135 parts of surfactant A, 55 parts of surfactant B, 10 parts of surfactant D, 10 parts of surfactant E, 80 parts of neutral wool-fat and 160 parts of "heavy alkylates" KA 30 (Montedison) are melted together at a temperature of 60°–65° C. and mixed homogenously as in Example 1. 85 parts of a 30% sodium hydroxide solution are added during 10 minutes with stirring, the temperature of the reaction mixture rising to 80° C. Then 465 parts of demineralised water are added portionwise.

At the beginning of the water addition a water-in-oil emulsion is formed, which, when 200 parts of water have been added, begins to invert to an oil-in-water emulsion; during the phase inversion the viscosity of the mixture increases, but the mixture is still easily stirrable. Up to the addition of 250–300 parts of water, the temperature is not allowed to decrease below 55° C. At this point the phase inversion is complete—a test sample being easily dilutable with water. The diluted sample is milky. The average particle size is below 2 μm.

The heating is disconnected and the remaining water is added. By the end of the water addition the temperature decreases to 50° C. The pH is 8.0. After the addition of water the mixture is stirred for 2 hours, and is discharged without further cooling.

EXAMPLE 3

Analogously to Example 2 the following components are mixed together to form a fatting dispersion: 110 parts of surfactant A, 110 parts of surfactant B, 15 parts of surfactant D, 15 parts of surfactant F, 80 parts of neutral wool-fat, 80 parts of "heavy alkylates" KA 30 (Montedison), 95 parts of an aqueous 30% sodium hydroxide solution and 495 parts of water.

EXAMPLE 4

Example is repeated using 130 g of surfactant A instead of 10 g.

EXAMPLE 5

Production of impermeable shoe-upper leather

Substrate: chrome-tanned cow-hides (wet-blue-leather) of 1.5 mm wet-thickness.

The leather is washed in a re-tanning vessel with 200% of water at 35° C. for 10 minutes, then the liquor is drained of and 100% of an aqueous liquor at 35° C. containing 1% of sodium formate and 0.5% sodium bicarbonate are added and the treatment is continued for 40 minutes. The pH of the liquor is between 4.5 and 5.0. In the same bath the leather is re-tanned with 4% of polyacrylic acid, during 40 minutes, then with 4% syntan (condensation product of an aromatic sulfone, aromatic sulfonic acid and formaldehyde) and 2% dimethylolethyleneurea for further 40 minutes. Then the liquor is drained off and the leather is washed in a fresh liquor of 200% of water at 50° C. for 10 minutes. Then the liquor is drained off.

The leather is then dyed in a fresh liquor of 100% of water at 55° C. with 0.8% C.I. Acid Brown 359 during 30 minutes; 8–10% of the dispersion of Example 1 (dry content with respect to the dry weight of the leather) are added and the treatment of the leather with this liquor is continued for 90–120 minutes. Then, the liquor is acidified with 1% of 85% strength formic acid (diluted 1:5); after 20 minutes of this treatment the fat liquor is practically completely exhausted. Then, 2–3% chromium sulfate (titration: 25% $Cr_2O_3$, basified to 33%) are added for fixation. A high-quality leather with water-repellant properties is obtained.

EXAMPLE 6

Example 5 is repeated, using the dispersion of Example 2 instead of the dispersion of Example 1. The treated leather is very well fatted and has good water-repellant properties.

EXAMPLE 7

The process of Example 5 is repeated, using the dispersion of Example 3 instead of the dispersion of Example 1. The treated leather is very well fatted and has good water-repellant properties.

EXAMPLE 8

Example 5 is repeated, using the dispersion of Example 4 instead of the dispersion of Example 1. The treated leather is very well fatted and has good water-repellant properties.

What is claimed is:

1. A process for fatting a tanned leather or tanned pelt substrate which comprises the steps of (1) fatting the substrate with an aqueous dispersion containing (a) a leather-fatting agent which is a natural leather-fatting agent or a chemically modified natural leather-fatting agent or a mixture thereof, and (b) a mixture of ($b_1$) at least one hydrosoluble or hydrodispersible suface-active phosphoric acid partial ester of an oxyalkylated higher fatty alcohol, selected from $C_{14-20}$alkanols and $C_{14-20}$alkenols, containing up to 10 alkylene oxide units per fatty alcohol radical, or an alkali metal or ammonium salt thereof, and ($b_2$) at least one hydrosoluble or hydrodispersible surface-active phosphoric acid partial ester of a non-oxyalkylated higher fatty alcohol selected from $C_{14-20}$ alkanols and $C_{14-20}$ alkenols, or an alkali metal or ammonium salt thereof, and (2) after-treating the substrate in an aqueous medium with a polyvalent metal cation.

2. A process according to claim 1, wherein the partial ester are of formulae (I) or (II)

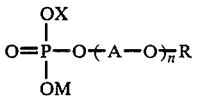

(I)

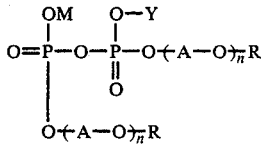

(II)

in which

M is hydrogen, alkali metal or ammonium,

X and Y independently are M or —(A-O)$_n$R, each R independently is $C_{14-20}$-alkyl or $C_{14-20}$-alkenyl each A independently is ethylene-1,2 or propylene-1,2 and each n independently is 0 for ($B_2$) an average number from 1 to 10 for ($b_1$) and where n>1 the alkylene groups A within the group —(A-O)$_n$ may be the same or different.

3. A process according to claim 2 wherein the weight ratio of the partial ester of the non-oxyalkylated alcohol to the partial ester of the oxyalkylated alcohol is between 1:5 and 1:0.5.

4. A process according to claim 2 wherein component (a) is a natural leather-fatting agent, a methyl ester of a $C_{14-22}$ fatty acid, or a mixture thereof.

5. A process according to claim 1 wherein the phosphoric acid partial esters are orthophosphoric acid partial esters.

6. A process according to claim 1 wherein the aqueous dispersion contains in addition to components (a) and (b), (c) a non-ionic or an anionic carboxy- or sulpho-group containing surfactant or a mixture thereof.

7. A process according to claim 6 wherein at least one of the surfactants has W/O-emulsifier character.

8. Tanned leather treated by a process according to claim 6.

9. A process according to claim 1, wherein component (a) is a natural leather fatting agent, a methyl ester of a $C_{14-22}$ fatty acid, or a mixture thereof.

10. A process according to claim 1 wherein component (b) is a mixture of orthophosphoric or pyrophosphoric acid partial esters or salts thereof and the alkylene portion of the alkylene oxide units is ethylene -1,2 or propylene-1,2.

11. A process according to claim 10 wherein the weight ratio of the partial ester of the non-oxyalkylated alcohol to the partial ester of the oxyalkylated alcohol is between 1:5 and 1:0.5.

12. A process according to claim 11 wherein component (a) is a natural leather-fatting agent, a methyl ester of a $C_{14-22}$ fatty acid, or a mixture thereof.

13. A process according to claim 10 wherein component (a) is a natural leather-fatting agent, a methyl ester of a $C_{14-22}$ fatty acid, or a mixture thereof.

14. A process according to claim 10 wherein component ($b_1$) is an orthophosphoric or pyrophosphoric acid partial ester of an ethoxylation product of tetradecanol or of cetyl, stearyl, oleyl or tallow alcohol, or a salt of such ester.

15. A process according to claim 14 wherein component ($b_2$) is a hydrosoluble or hydrodispersible surface active orthophosphoric or pyrophosphoric acid partial ester of non-alkoxylated tetradecanol or of cetyl, oleyl, stearyl or tallow alcohol or a salt of such ester.

16. A process according to claim 15 wherein component (a) is a natural leather-fatting agent, a methyl ester of a $C_{14-22}$ fatty acid, or a mixture thereof.

17. A process according to claim 10 wherein the weight ratio of component (a) to the total of the surfactants present in the aqueous dispersion is in the range 1:0.5 to 1:3.

18. A process according to claim 17 wherein the weight ratio of the partial ester of the non-oxyalkylated alcohol to the partial ester of the oxyalkylated alcohol is between 1:5 and 1:0.5.

19. A process according to claim 18 wherein the concentration of component (a) is within the range 2–8%, by weight, with respect to the wet-weight of the leather and the pH of the aqueous dispersion is in the range 4–7.

20. A process according to claim 19 wherein step 2 comprises treatment with an oxide, hydroxide or salt of magnesium, calcium, barium, aluminum chromium (III) or zirconyl, in an amount, calculated as metal cations, of 5 to 20% of the dry weight of the phosphoric acid partial ester.

21. A process according to claim 18 wherein component (a) is a natural leather-fatting agent, a methyl ester of a $C_{14-22}$ fatty acid, or a mixture thereof.

22. A process according to claim 17 wherein the concentration of component (a) is within the range 2–15%, by weight, with respect to the wet-weight of the leather and the pH of the aqueous dispersion is in the range 2–9.

23. A process according to claim 1 wherein the oxyalkylated fatty alcohol contains 2 to 10 alkylene oxide units per fatty alcohol radical.

24. A process according to claim 23 wherein the oxyalkylated alcohol contains from 2 to 6 ethyleneoxy units per alcohol molecule.

25. A process according to claim 1 wherein the weight ratio of component (a) to the total of the surfactants present in the aqueous dispersion is in the range 1:0.5 to 1:3.

26. A process according to claim 25 wherein the concentration of component (a) is within the range 2–15%, by weight, with respect to the wet-weight of the leather.

27. A process according to claim 1 wherein step (2) comprises treatment with an oxide, hydroxide or salt of magnesium, calcium, barium, aluminum, chromium (III) or zirconyl in an amount, calculated as metal cations, of 1 to 100% of the dry weight of the phosphoric acid partial ester.

28. Tanned leather or pelt substrate treated by a process according to claim 1.

29. An aqueous dispersion containing (a) a leather-fatting agent which is a natural leather-fatting agent or a chemically modified natural leather-fatting agent or a mixture thereof, and (b) a mixture of ($b_1$) at least one hydrosoluble or hydrodispersible suface-active phosphoric acid partial ester of an oxyalkylated higher fatty alcohol, selected from $C_{14-20}$alkanols and $C_{14-20}$alkenols, containing up to 10 alkylene oxide units per fatty alcohol radical, or an alkali metal or ammonium salt thereof, and ($b_2$) at least one hydrosoluble or hydrodispersible surface-active phosphoric acid partial ester of a non-oxyalkylated higher fatty alcohol selected from $C_{14-20}$ alkanols and $C_{14-20}$ alkenols, or an alkali metal or ammonium salt thereof.

30. An aqueous dispersion according to claim 29 wherein component (a) is a natural leather-fatting agent or a methyl ester of a $C_{14-20}$-fatty acid or a mixture thereof.

31. An aqueous dispersion according to claim 29 wherein the weight ratio of the phosphoric acid partial ester of a non-oxyalkylated higher fatty alcohol to the phosphoric acid partial ester of an oxyalkylated higher fatty alcohol is between 1:5 and 1:0.5.

32. An aqueous dispersion according to claim 29 containing, in addition to components (a) and (b), (c) a non-ionic or anionic carboxy or sulpho group containing surfactant or a mixture thereof.

33. A process for the production of an aqueous dispersion according to claim 26 in which component (b) is in salt form, wherein a base for salt formation is added after admixing components (a) and (b); in acid form; and before or after the addition of water.

34. A dispersion according to claim 20 wherein component (b) is a mixture of orthophosphoric or pyrophosphoric acid partial esters or salts thereof and the alkylene portion of the alkylene oxide units is ethylene-1,2 or propylene-1,2.

35. A dispersion according to claim 34 wherein the weight ratio of component (a) to the total of the surfactants present in the aqueous dispersion is in the range 1:0.5 to 1:3.

36. A dispersion according to claim 3 wherein component (a) is a natural leather-fatting agent, a methyl ester of a $C_{14-22}$ fatty acid, or a mixture thereof.

37. A dispersion according to claim 36 wherein the weight ratio of the partial ester of the non-oxyalkylated alcohol to the partial ester of the oxyalkylated alcohol is between 1:5 and 1:0.5 and the weight ratio of component (a) to the total of the surfactants present in the aqueous dispersion is in the range 1:0.5 to 1:3.

38. A dispersion according to claim 20 wherein component ($b_1$) is an orthophosphoric or pyrophosphoric acid partial ester of an ethoxylation product of tetradecanol or of cetyl, stearyl, oleyl or tallow alcohol, or a salt thereof.

39. A dispersion according to claim 38 wherein component ($b_2$) is an orthophosphoric or pyrophosphoric acid partial ester of non-oxyalkylated tetradecanol or of cetyl, stearyl, oleyl or tallow alcohol, or a salt thereof.

40. A dispersion according to claim 39 wherein the weight ratio of the partial ester of the non-oxyalkylated alcohol to the partial ester of the oxyalkylated alcohol is between 1:5 and 1:0.5.

41. A dispersion according to claim 40 wherein the weight ratio of component (a) to the total of the surfactants present in the aqueous dispersion is in the range 1:0.5 to 1:3.

42. A dispersion according to claim 41 wherein component (a) is a natural leather-fatting agent, a methyl ester of a $C_{14-22}$ fatty acid, or a mixture thereof.

43. A dispersion according to claim 29 wherein the weight ratio of component (a) to the total of the surfactants present in the aqueous dispersion is in the range 1:0.5 to 1:3.

* * * * *

UNITED STATES PATENT AND TRADEMARK OFFICE

CERTIFICATE OF CORRECTION

PATENT NO. : 4,740,210

DATED : April 26, 1988

INVENTOR(S) : Werner Amati and Markus Badertscher

It is certified that error appears in the above-identified patent and that said Letters Patent is hereby corrected as shown below:

Column 2, line 59; "x" should read -- X --.

Column 3, line 12; "formula" should read -- formulae --.

Column 6, line 18; "surfactant a" should read -- surfactant A --.

Claim 2, second line; "ester" should read -- esters --.

Claim 2, sixth line below the formulae; "$(B_2)$ an" should read -- $(b_2)$ and an --.

Claim 33, second line; "26" should read -- 29 --.

Claim 33, fourth line; the two semi-colons should be commas.

Claim 34, first line; "20" should read -- 29 --.

Claim 36, first line; "3" should read -- 34 --.

Claim 38, first line; "20" should read -- 29 --.

Signed and Sealed this

Twenty-seventh Day of September, 1988

*Attest:*

DONALD J. QUIGG

*Attesting Officer*

*Commissioner of Patents and Trademarks*